United States Patent [19]

Won

[11] Patent Number: 4,648,531

[45] Date of Patent: Mar. 10, 1987

[54] DISPENSER FOR BAG CLOSURES

[75] Inventor: Yong K. Won, Seoul, Rep. of Korea

[73] Assignee: Ben Clements & Sons, Inc., South Hackensack, N.J.

[21] Appl. No.: 708,464

[22] Filed: Mar. 5, 1985

[51] Int. Cl.[4] ..... B65H 1/08; B65B 61/00

[52] U.S. Cl. ..... 221/232; 221/188; 221/190; 221/198; 227/83; 53/417

[58] Field of Search ..... 221/20, 188, 190, 198, 221/232; 227/83; 53/138 A, 417

[56] References Cited

U.S. PATENT DOCUMENTS

| | | | |
|---|---|---|---|
| 2,705,100 | 3/1955 | Paxton et al. | 53/417 |
| 3,061,983 | 11/1962 | Irwin | 53/417 |
| 3,163,969 | 1/1965 | Irwin et al. | 53/138 A |
| 3,298,570 | 1/1967 | Skorey et al. | 221/272 |
| 3,829,954 | 8/1974 | Takamizawa et al. | 221/232 X |
| 4,189,062 | 2/1980 | Jackson | 221/188 |
| 4,556,161 | 12/1985 | Oide | 227/83 |

*Primary Examiner*—Joseph J. Rolla

*Assistant Examiner*—Jay I. Alexander

*Attorney, Agent, or Firm*—Blum Kaplan Friedman Silberman & Beran

[57] ABSTRACT

A dispenser for closures ejects an end-most closure contained in a pivotably mounted housing for closing a bag. The closures are formed with a hole and a cut leading from one side to the hole. In one embodiment, the dispenser is wall mounted such that a weight may be used for feeding closures to a dispensing position. A second embodiment uses a spring feed for urging the closures to the feeding position. The housing is formed with facings slots at the front end thereof, a pusher being mounted on a base member. When the housing is pivoted toward the base member, the pusher extends through one slot to displace the end-most closure through the other slot. The dispenser may include cams on either side of the dispensing slot for spreading the portions of the closure on each side of the cut, thereby faciliating application of the closure element to the neck of a bag.

3 Claims, 20 Drawing Figures

FIG. 1
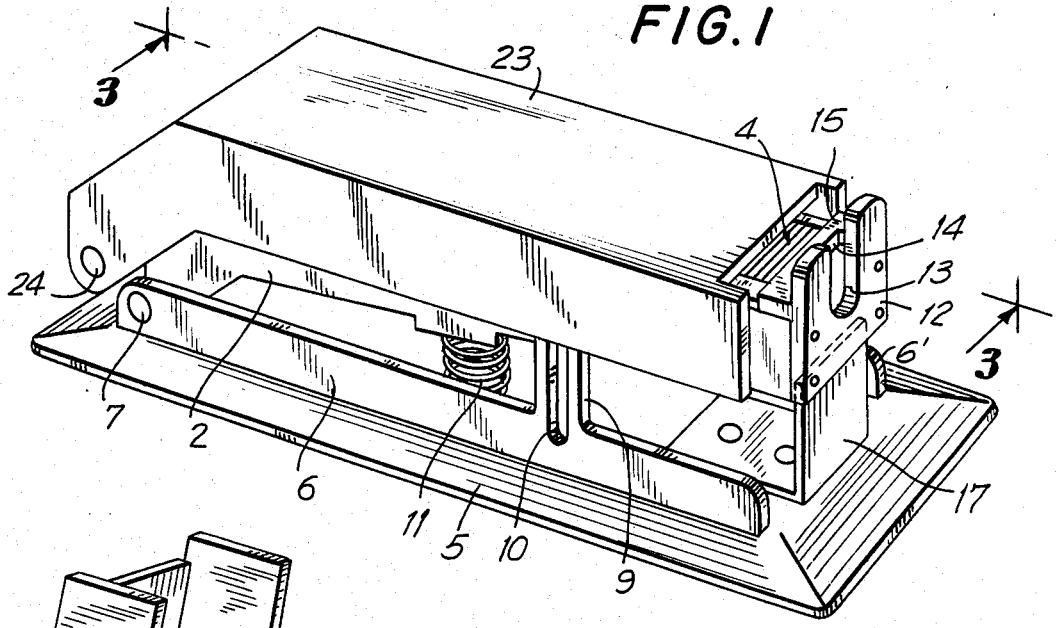
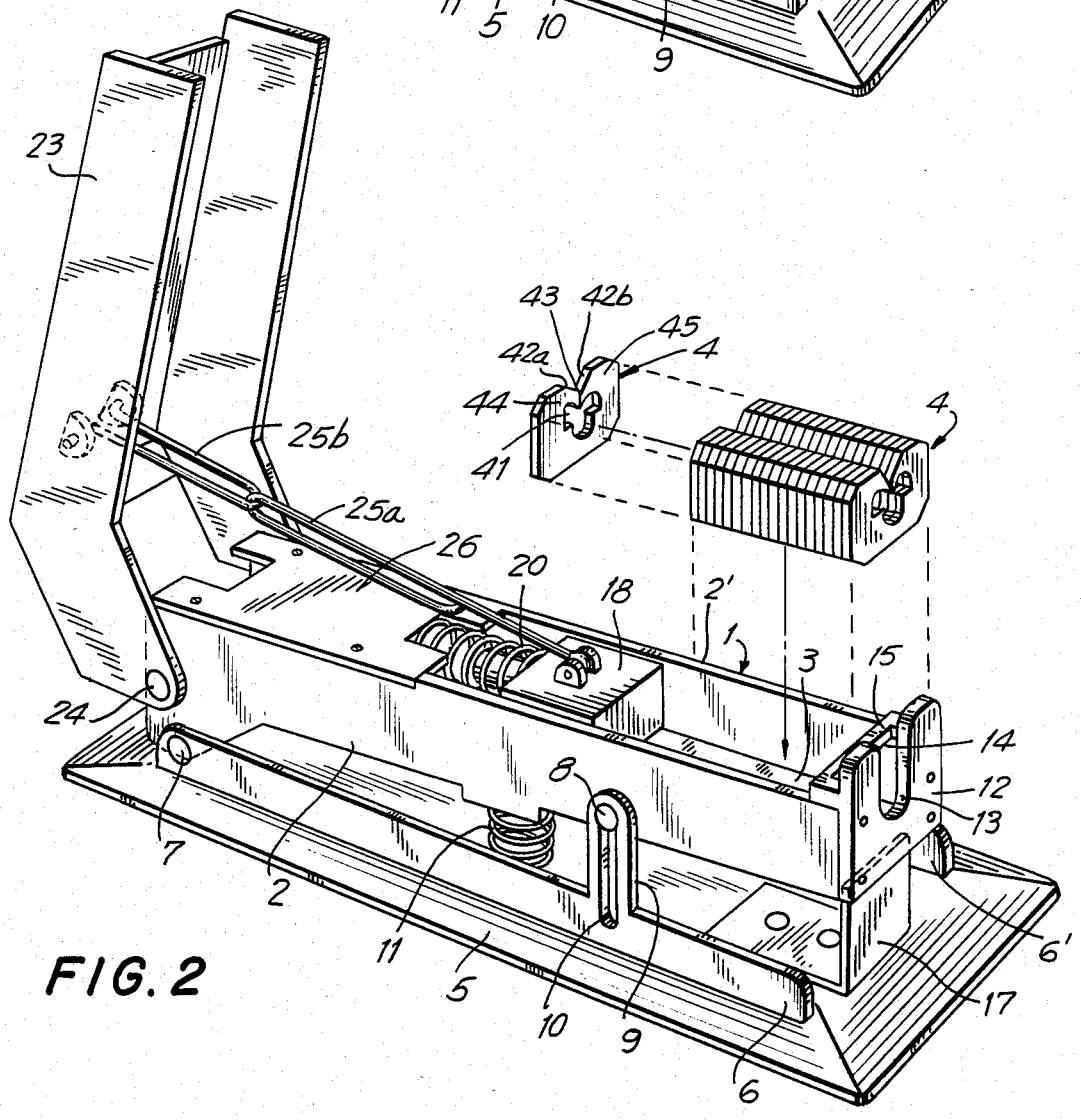
FIG. 2

FIG. 17
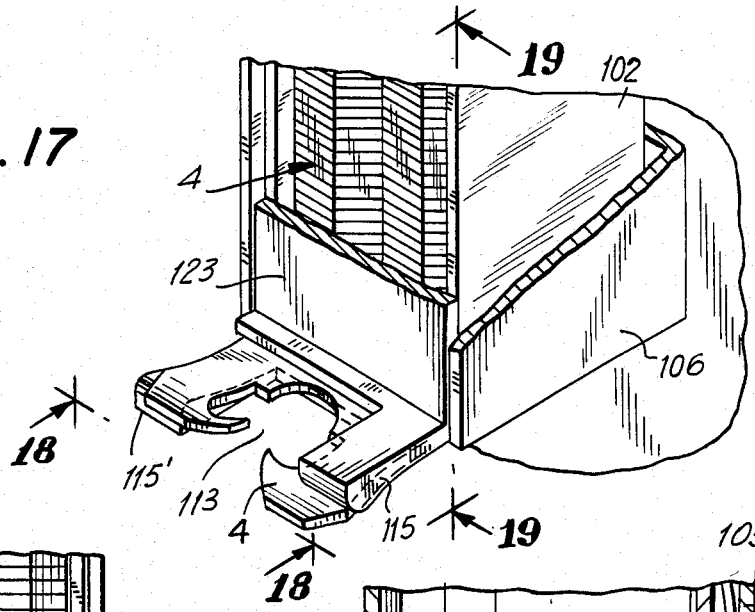
FIG. 18
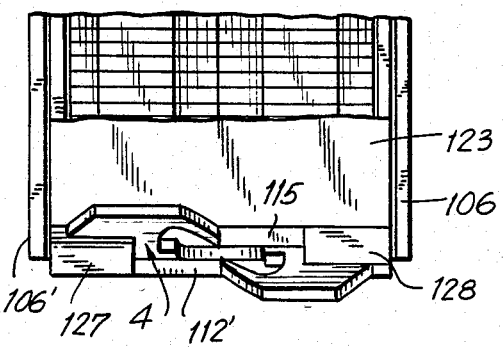
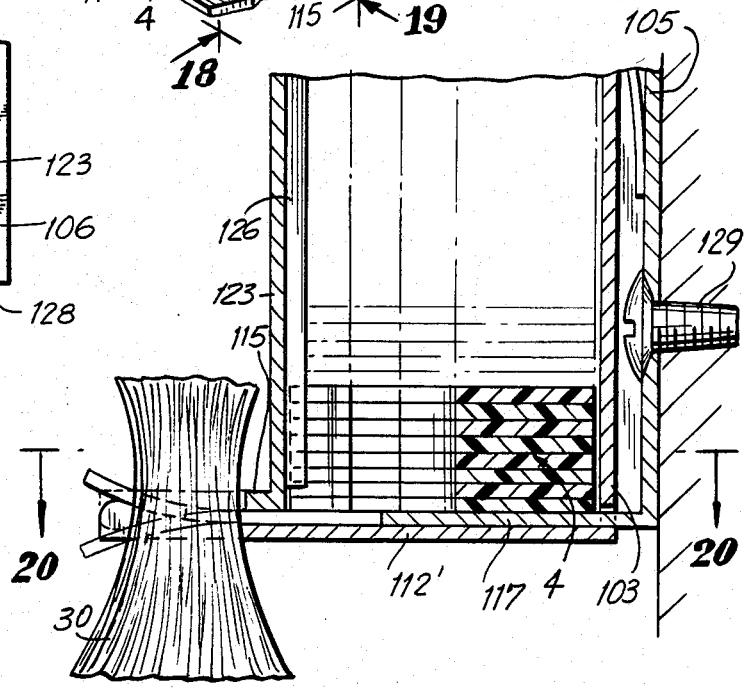
FIG. 19
FIG. 20
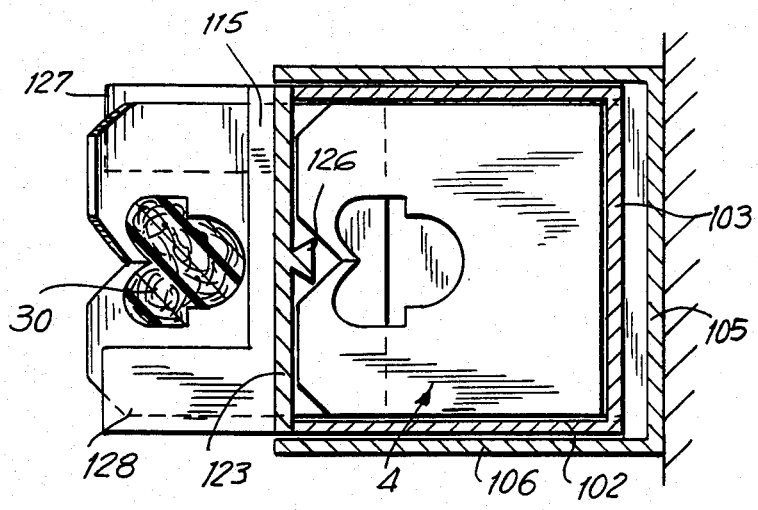

DISPENSER FOR BAG CLOSURES

BACKGROUND OF THE INVENTION

This invention relates generally to a dispenser for reusable closures for attachment to and sealing of a bag, such as a plastic bag.

The use of plastic bags in supermarkets and other stores has become quite prevalent. Consequently, many means have been devised for tying the bag after an item is placed within.

One method has been to tie the end of a bag manually by means of a twist-tie or other string-like device. However, this method requires physical effort when used and is particularily unsuitable for the elderly or arthritic.

An alternative method has been the use of a band with a snap end. However, the cost of manufacture the band is great and storage for use is impractical.

In order to overcome these drawbacks, a small plastic chip having a central hole and a cut on one side communicating with the central hole, referred to as a closure, has been constructed. Use of the closure consists of insertion of the plastic bag's top portion, at the open end thereof, within the closure's hole.

Traditionally, this type of closure is dispensed from a roll. This necessitates a large sized dispenser utilizing valuable counter space or attachment to a wire wheel adjacent to a roll of plastic bags. Additionally, purchasers tend to take large quantities of the closures for their own personal use at some future date. Accordingly, it is desirable to provide a dispenser for plastic closures which is economical, efficient and simple to operate.

SUMMARY OF THE INVENTION

Generally speaking, in accordance with the invention, a dispenser for reusable closures is disclosed which ejects the end-most closure of a side by side magazine or stack of closures within the dispenser. The closures are dispensed one at a time in response to a pushing force for sealing a bag, in particular, a plastic bag. The dispenser includes a housing for receiving the magazine or stack or closures and having facing slots in the side walls thereof adjacent the end wall of the housing. The housing is pivotably mounted at the end spaced from the slots for displacement toward and away from a finger dimensioned and positioned to extend through one of the slots to displace a closure through the other slot.

The closures are preferably flat and formed of a resilient material. The closures are formed with a central hole dimensioned to receive the neck of a bag and a cut communicating with the hole. The entrance to the cut is cut away to guide the neck of the bag to the cut and hole.

At least one cam is positioned at the outlet of the slot through which the closures are dispensed for displacing at least the region of the closure at one side of the cut out of the plane thereof for opening an access path to the hole for the neck of a bag. Two such cams may be provided for displacing the regions of the closure at both sides of the cut in opposite directions from the plane of its closure.

The dispenser may include a member based in the housing toward the slots for feeding successive closures into registration with the slots. In another embodiment, the dispenser is attached to a wall such that the slots are at the lower end of the housing. A weight may be used for feeding the closures to the displacing position. The housing may be biased to a position at which the finger is out of engagement with the closure.

Accordingly, it is an object of the invention to provide an improved dispenser for reuseable closures.

It is another object of the invention to provide an improved dispenser for reusable closures requiring little effort to operate.

It is a further object of the invention to provide an improved dispenser for reusable closures that is economical and efficient.

Still another object of the invention is to provide an improved dispenser for reuseable closures which eject the endmost closures one at a time for sealing a bag.

Still a further object of the invention is to provide an improved dispenser for reuseable closures that is wall mountable.

An even further object of the invention to provide an improved dispenser for reuseable closures which can be used by the consumer.

Still other objects and advantages will in part be obvious and will in part be apparent from the specification.

The invention accordingly comprises the features of construction, combinations of elements and arrangements of parts which will be exemplified in the constructions hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is perspective view of a first embodiment of a dispenser in accordance with the invention;

FIG. 2 is a perspective view of the dispenser of FIG. 1 with its cover opened and closures 4 in exploded position;

FIG. 17 is a perspective view of the head of a fourth embodiment of the dispenser in accordance with the invention;

FIG. 18 is a front elevational view with portions broken away of the embodiment of FIG. 17;

FIG. 19 is a cross-sectional view of the embodiment of FIG. 17 in the dispensing position, with a bag in position; and FIG. 20 is a cross-sectional view taken along line 12—12 of FIG. 19.

DESCRIPTION OF THE PREFERRED EMBODIMENTS

Figure 3:
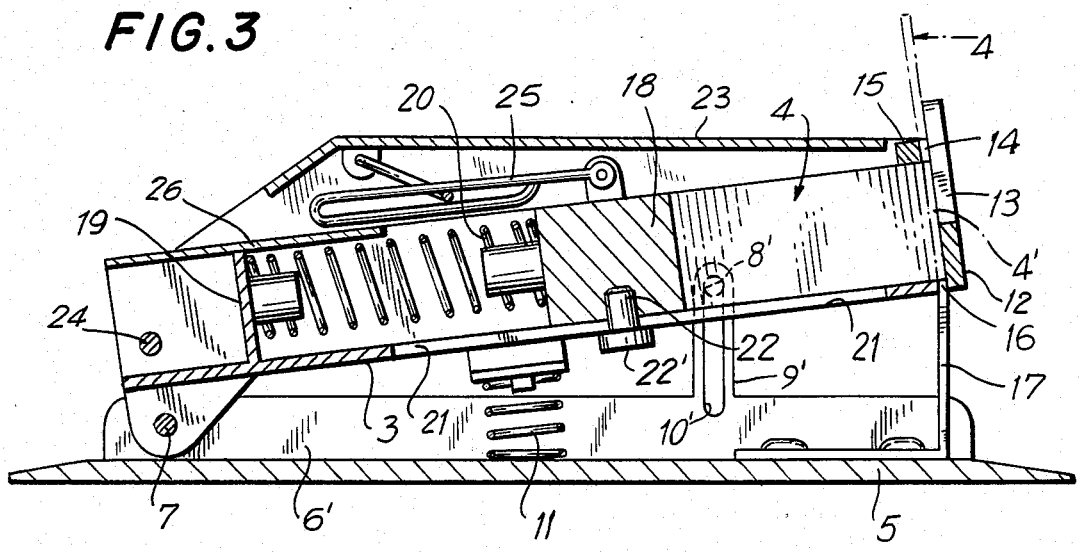
FIG. 3 is a cross-sectional view taken along line 3—3 of FIG. 1.

Referring first to FIGS. 1–3, a dispenser according to the present invention has a base member 5 and side members 6 and 6'. A housing 1 is pivotably supported on a pivot pin 7 extending through the rear portion of housing 1 and side members 6 and 6' to pivotably couple the housing upon base member 5.

Housing 1 consists of side panels 2, 2' and bottom panel 3 providing a container for closure elements 4. Pins 8, 8' extend from side panels 2, 2' into slits 10, 10' in protrusions 9, 9'. Protrusions 9, 9' extend upwardly from side members 6, 6', for guiding housing 1 in its pivotable displacement.

Spring 11, extending from bottom panel 3 of housing 1 to base member 5, biases housing 1 in an upward direction, resulting in the automatic upward displacement of housing 1, after a downward force is released. Housing 1 thus will move upward until stopped by pins 8 contacting the top of slits 10, 10'.

A front member 12 of housing 1, is attached to side panels 2, 2' along the bottom region of said front member 12 so as to form and end wall of the housing. The top of front member 12 is formed with a slot 13 in registration with the central hole 42 and cut 43 of a closure 4 (FIG. 2). Attachment of front member 12 to projecting member 15 defines slot 14 between the two.

As shown in FIG. 3, a slot 16 is formed between bottom panel 3 and front member 12. Slot 16 is dimensioned to receive feeding bar 17, which is connected to the front region of base 5.

A slider 18 is received within housing 1 for urging closures 4 towards the head region (end wall 12) of the housing. A spring 20 is connected between a rear panel 19 and slider 18 for continuously urging closures 4 in the direction of end wall 12. Secured to the bottom of slider 18 is a bolt 22, having a head 22'. Bolt 22 slides in a slit 21 and serves to prevent slider 18 from disengaging with bottom panel 3. Alternative means for preventing such disengagement may be provided, such as bending inward by the top of side panels 2, 2'.

A cover 23 is pivotably mounted in housing 1 by a pin 24 which extends through side panels 2, 2' at their rear. A wire 25*a* is pivotably mounted to the top of slider 8 at one end. Wire 25*a* defines a longitudinally extending slot which receives a V-shaped wire 25*b* which is pivotably mounted on the inner surface of cover 23. Wires 25*a* and 25*b* serve to displace rearwardly slider 18 against the spring force of spring 20 when the cover is lifted. A spring cover 26 is secured to side panels 2, 2' for retaining spring 20.

In operation, cover 23 is lifted and closures 4 are loaded within magazine 1, between slider 18 and front member 12. The cover is then closed. Slider 18 will urge forward the closures by means of spring 20 such that the foremost closure will be positioned underneath slot 14 and above slot 16 and feeding bar 17.

When pressure is exerted on top of cover 23, housing 1 is pivoted downward. Consequently, feeding bar 17 pushes upward a closure through slot 16 and slot 14. When pressure is released, the housing will return to its starting position by reason of spring 11 and feeding bar 17 will be removed from slot 16. At the same time, the next closure is urged forward and positioned under slot 14 for use in a second application of the device.

Figure 4:
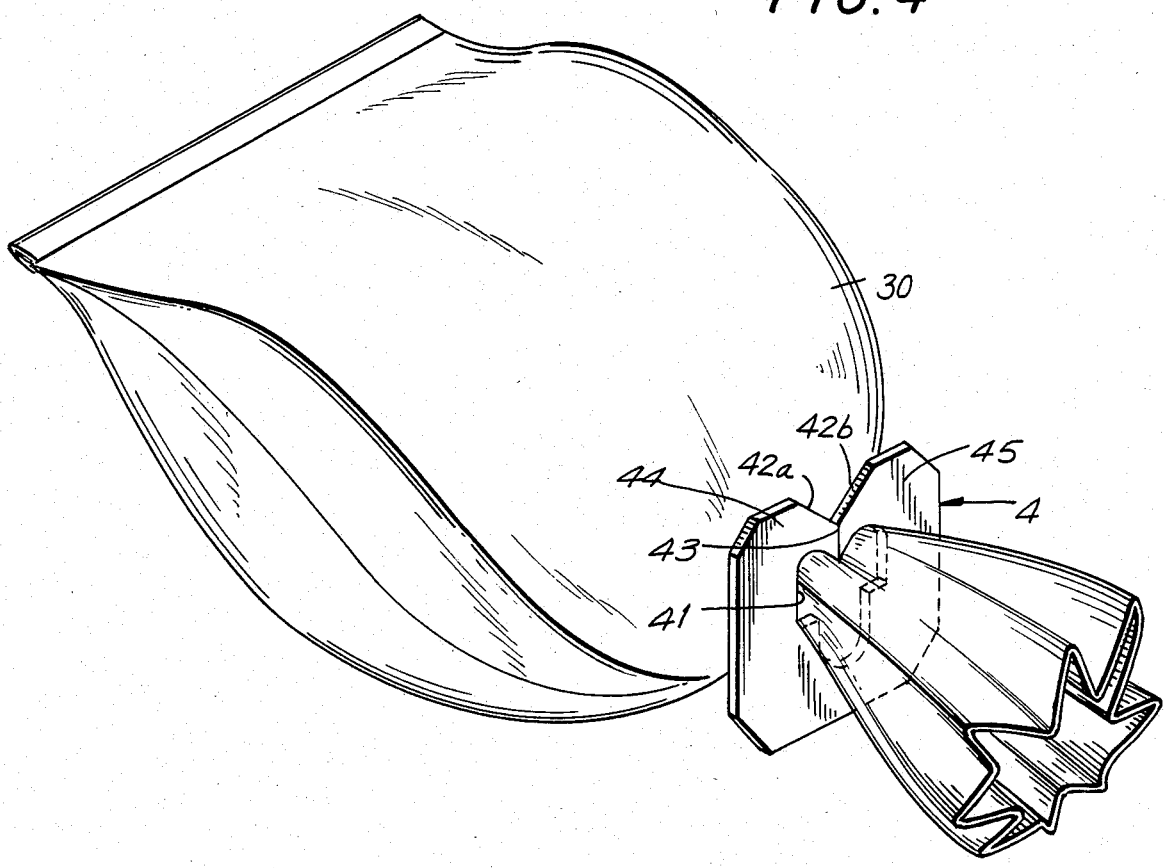
FIG. 4 is a perspective view of a plastic bag bound by a closure.
Figure 5:
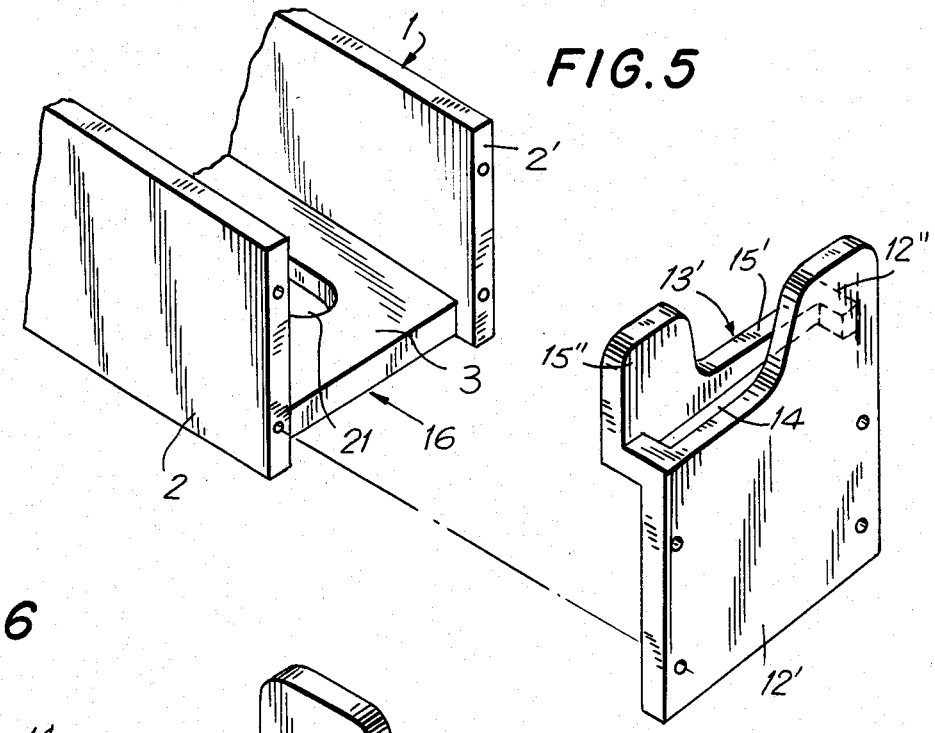
FIG. 5 is an exploded perspective view of a second embodiment of the end wall of the dispenser housing in accordance with the invention.

When using the device, the top end or neck of a bag such as a plastic bag 30, can be inserted in the entrance to slot 13. As is more particularly shown in FIGS. 2 and 4, the closure is formed with a central hole 41 with access to the hole being through a cut 43 defined between arms 44 and 45. The entrance to the cut is defined by inclined camming surfaces 42*a* and 42*b*. When manual pressure is applied to cover 23, housing 1 pivots on pin 7 displacing upwardly the first closure 4. As the closure is displaced upwardly, the neck of the bag retained by the user is forced through cut 43, having been guided by camming surfaces 42*a* and 42*b*, until the closure surrounds and closes the neck of the bag, as shown in FIG. 4. Referring to FIG. 5, an alternate construction for the front wall of the housing is depicted, like reference numerals being applied to like elements. In the embodiment of FIG. 5, the top of front member 12' is formed with a raised upper portion 12". Similarly, the top of guard member 15' is formed with a raised upper portion 15" on the side thereof spaced from raised upper portion 12", so as to define a slotted region 13' therebetween.

Figure 6:
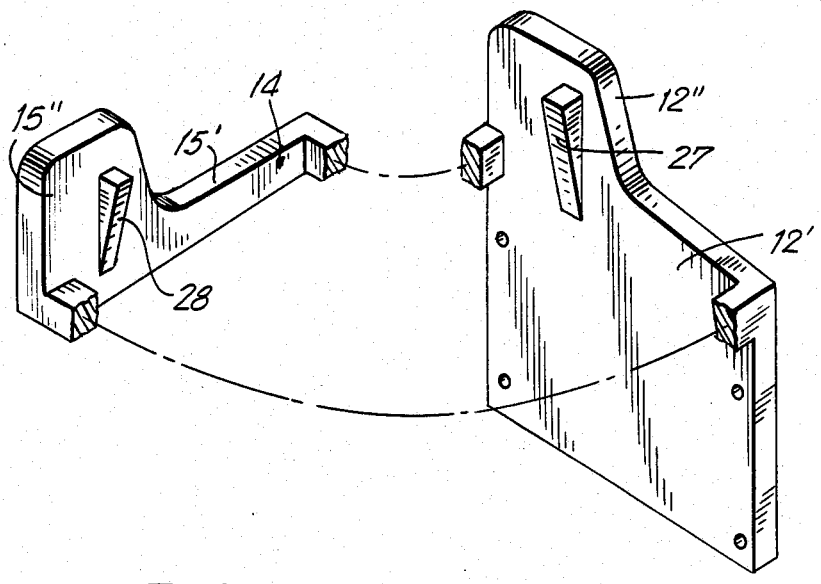
FIG. 6 is an exploded perspective view of a third embodiment of the end wall of the dispenser in accordance with the invention.
Figure 7:
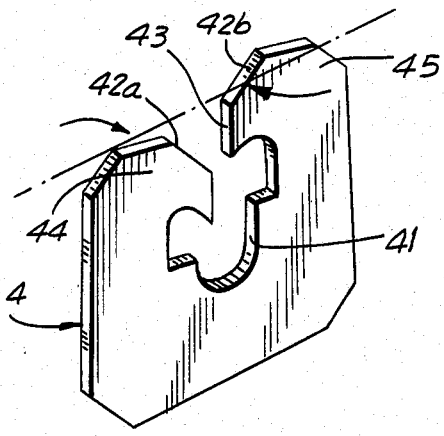
FIG. 7 is a perspective view of a closure in accordance with the invention showing displacement of the region of the closure adjacent the cut.
Figure 8:
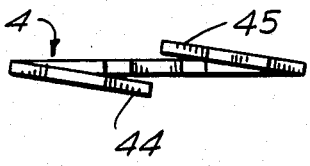
FIG. 8 is a tope plan view of the closure of FIG. 7 in accordance with the invention.
Figures 9, 10:
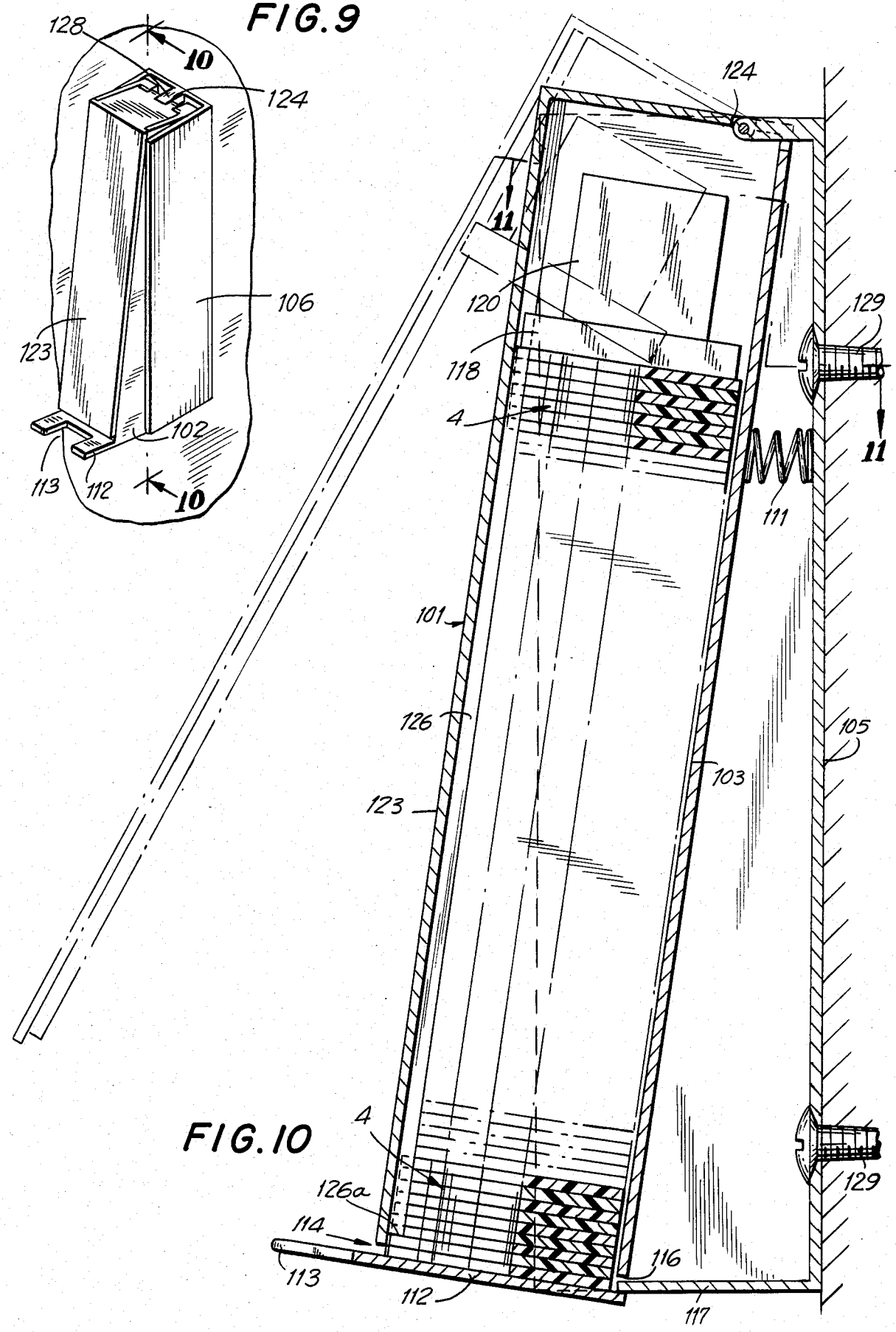
FIG. 9 is a perspective view of a second embodiment of the dispenser in accordance with the invention.
FIG. 10 is a cross-sectional view taken along line 10—10 of FIG. 9.
Figure 11:
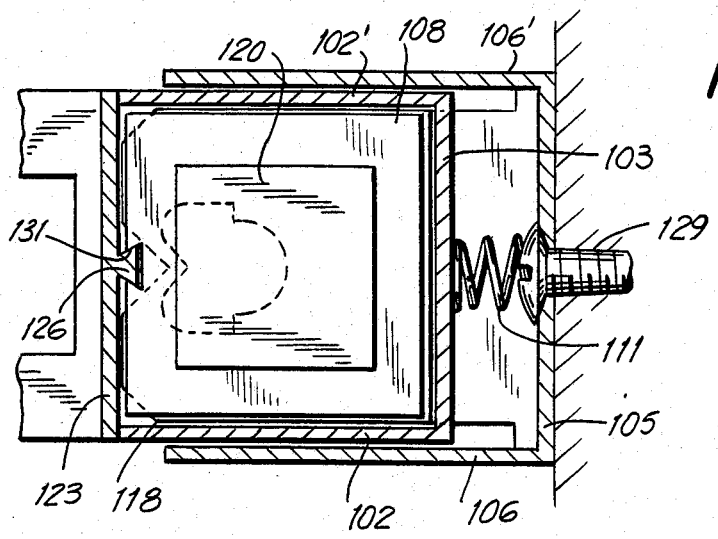
FIG. 11 is a cross-sectional view taken along line 11—11 of FIG. 10.
Figure 12:
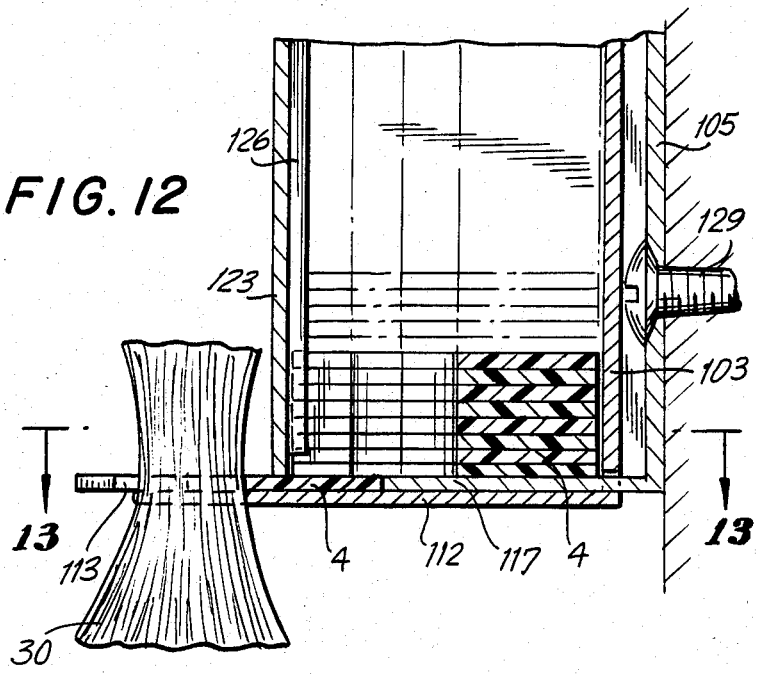
FIG. 12 is a fragmentary cross-sectional view of the head of the dispenser of FIG. 9 after displacement for feeding.
Figure 13:
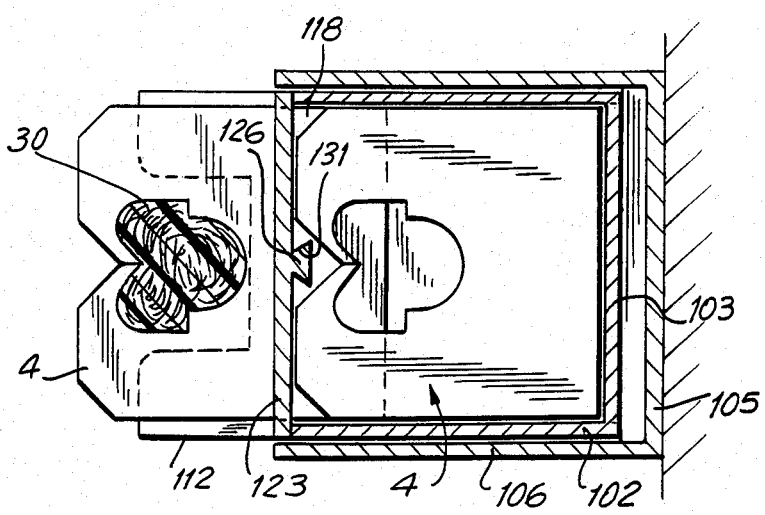
FIG. 13 is a cross-sectional view along line 13—13 of FIG. 12.

One problem encountered with the arrangement of FIGS. 1–5 is that it is sometimes difficult to force the closure around the neck of the bag because of the constriction at cut 43. This sometimes results in damage to the bag. In order to avoid this problem, in the embodiment of FIGS. 6–8, a first wedge-shaped cam 27 is provided on upwardly projecting portion 12" of front member 12 and a second wedge-shaped cam member 28 is provided on the inner surface of the upwardly projecting portion 15" of side member 15'. Cams 27 and 28 project into slot 14 and serve to twist arms 44 and 45 of each closure 4 in the direction of the arrows of FIG. 7 as the closure is forced through slot 14 to separate the arms and open cut 43 (FIGS. 7 and 8), to permit the easy insertion of the neck of a bag into hole 41. As the closure passes out of slot 14, the resilient arms 44 and 45 of the closure return to their original position, resulting in the firm positioning of the closure on the bag and the retaining of the bag in a closed position.

Referring now to FIGS. 9–13, a wall mounted dispenser in accordance with the invention is depicted. A housing member 101 may be attached to the wall by means of screws 129 spaced lengthwise along base member 105. Base member 105 has side walls 106 and 106' extending at right angles to the bottom thereof. Housing 101 consists of side panels 102 and 102' and a bottom panel 103, and is dimensioned to receive closure elements 4. A spring 111 extending from bottom panel 103 to base member 105 biases housing 101 to the position shown in FIG. 10; housing 101 being pivotably mounted on base member 105 by pin 124.

Housing 101 is provided with a cover 123 which is also pivotably mounted on pin 124. Cover 123 is provided with a trapezoidal-shaped guide rail 126 which supports a slider 118. Slider 118 is formed with a trapzoidal groove 131 in the upper surface thereof for receiving and riding along rail 126. Slider 118 may be mounted on rail 126 at the open end 126a thereof. A weight 120 is carried on slider 118. The weight, cooperating with slider 118 when the cover 123 is closed, engages the stack of closures 4 and serves to feed the closures, one after another, into registration with slot 14 defined between the end of cover 123 and front member 112 of the housing. A further slot 116 is provided in bottom panel 103, in registration with slot 114, for receiving feed member 117.

In operation, when housing 101 is pivotably displaced towards space member 105 by application of manual pressure to cover 123, the first closure 4 is displaced through slot 114 into registration with slot 113 formed in the upper region of front member 112.

When pressure is released on cover 123, feeder bar 117 is removed from slot 114 due to the opposed force created by spring 111. At the same time, a second closure is aligned with feeder bar 117 at a position lowermost in housing 101 due to the gravitational force of weight 120 exerted on slider 118.

Figure 14:
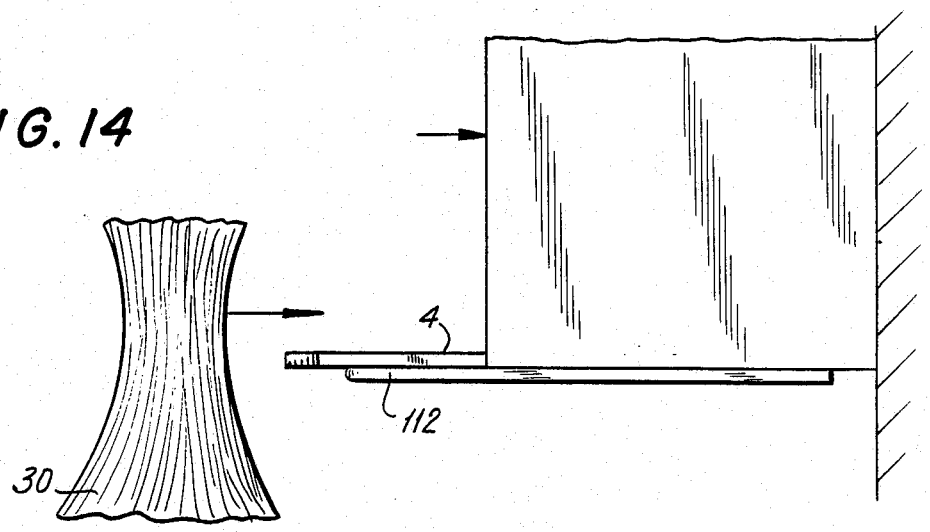
FIGS. 14–16 are fragmentary side elevational views of the head of the dispenser in FIG. 9 in accordance with the invention showing three methods of use.
Figure 15:
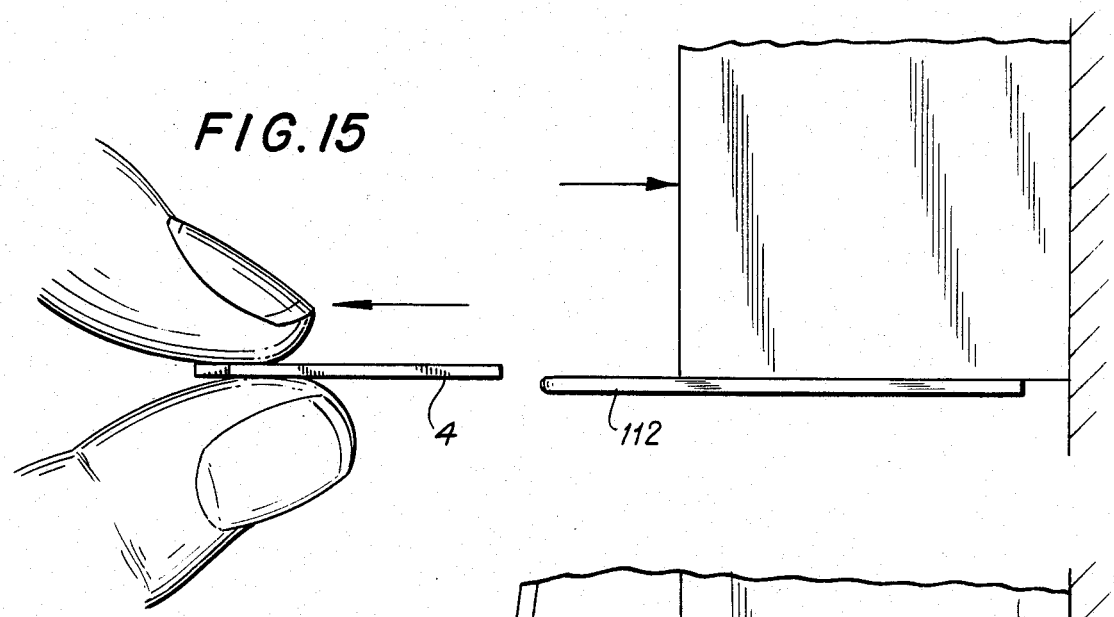
Figure 16:
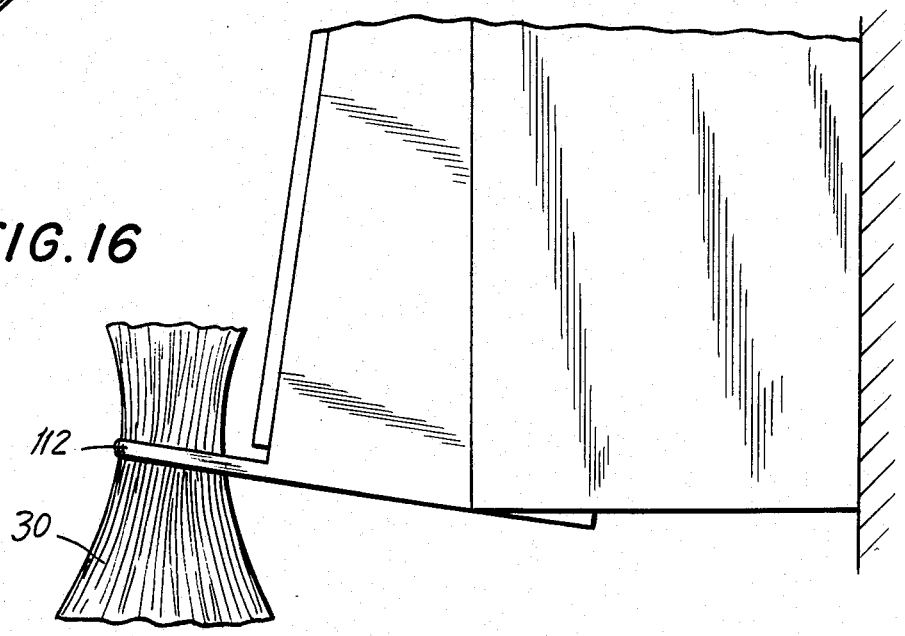

FIGS. 14–16 illustrative various methods of use of the dispenser disclosed in FIGS. 9–13. In FIG. 14, a bag 30 is pushed into the hole in a closure after said closure has been partially ejected from the dispenser and rests on front member 112. In FIG. 15, a closure 4 is first pulled out from the dispenser after being ejected for later application to a plastic bag. In FIG. 16, bag 30 is placed and held in dispenser opening 113 of front member 112 before a force is applied against the dispenser so as to eject the closure element to a position about said bag.

Referring now to a modified form of a wall mounted dispenser illustrated in FIGS. 17–20, this dispenser differs from the prior described dispenser in that there is intergration of cam elements in the dispenser head providing a staggered planar arrangement of each closure 4 as it is ejected from the dispenser. Front member 112 has a cam element 127 and a cam element 128, respectively formed on the inner ends of a front member 112' and a guide member 115. Cams 127 and 128 function in the same manner as cams 27 and 28 of FIG. 6. Cam elements 127 and 128 open a closure by planar staggering of the arms thereof defined by cut 43. This feature facilitates application of closure elements 4 to bag 30 and the sealing thereof.

Closures 4 can be loose or loosely joined together in groups as desired for efficient handling.

It will thus been seen that the objects set forth above, among those made apparent from the preceeding description, are efficiently obtained and, since certain changes may be made in the above constructions withut departing from the spirit and scope of the invention, it is intended that all matter contained in the above description or shown on the accompanying drawings shall be interpreted as illustrative and not in limiting sense.

It is also to be understood that the following claims are intended to cover all of the generic features of the invention herein described and all statements of the scope of the invention which, as a matter of language, might be said to fall therebetween.

What is claimed is:

1. A dispenser for closures having a central hole and a cut extending from a side thereof and providing access to the hole comprising:

a base member;

a housing for retaining a plurality of said closures in abutting relation with their respective holes and cuts in substantial alignment, said housing having a front and a rear, said housing being pivotably mounted at the rear thereof to said base member, said housing being formed with a first slot at the front thereof facing said base member and a second dispensing slot facing said first slot and on the side of said housing facing away from said base member;

pusher means supported on said base member positioned to pass through said first slot for dispensing the front most closure through said second dispensing slot upon the pivoting of said housing member towards said base member;

means for displacing the next closure into registration with said slots;

a front member defining the front of the housing and including a projecting portion projecting in the direction of dispensing of said closures, the front member projecting portion being of a width less than one half of the width of the second dispensing slot and being positioned on one side of and in spaced relation to the center of the width of the second dispensing slot, said housing further including a guide member spaced from said front member for defining said second dispensing slot therebetween and including a projecting portion extending in the direction of dispensing of said closures, said guide member projecting portion being of a width less than one half of the width of the second dispensing slot and being positioned on the other side of the center of the width of the second dispensing slot in spaced relation to the center of the width of the second dispensing slot; and a cam means carried on the inner surface of each of the front member projecting portion and the guide member projecting portion for displacing the regions of each closure on opposed sides of the cut in opposite directions out of the plane of the closure for ease of insertion of a bag therethrough.

2. A dispenser according to claim 1, wherein said closure is formed of a resilient plastic material.

3. A dispenser according to claim 1, wherein the space between the respective projecting portions of the front member and guide member is dimensioned to receive the neck of a bag.

* * * * *